US007350661B2

(12) United States Patent
Endou

(10) Patent No.: US 7,350,661 B2
(45) Date of Patent: Apr. 1, 2008

(54) CONTAINER

(75) Inventor: Haruhiro Endou, Chiba (JP)

(73) Assignee: Kyoraku Co., Ltd., Tokyo (JP)

( * ) Notice: Subject to any disclaimer, the term of this patent is extended or adjusted under 35 U.S.C. 154(b) by 385 days.

(21) Appl. No.: 10/148,657

(22) PCT Filed: Nov. 29, 2000

(86) PCT No.: PCT/JP00/08416

§ 371 (c)(1),
(2), (4) Date: May 30, 2002

(87) PCT Pub. No.: WO01/40063

PCT Pub. Date: Jun. 7, 2001

(65) Prior Publication Data

US 2002/0179601 A1 Dec. 5, 2002

(30) Foreign Application Priority Data

Nov. 30, 1999 (JP) ..... 11/341278

(51) Int. Cl.
*B65D 6/16* (2006.01)

(52) U.S. Cl. ..... 220/6; 206/521

(58) Field of Classification Search ..... 206/521, 206/600; 220/6, 7, 4.28; 446/487, 488
See application file for complete search history.

(56) References Cited

U.S. PATENT DOCUMENTS 4,020,967 A * 5/1977 Hammond et al. ..... 220/6
4,163,495 A * 8/1979 Drader ..... 206/506
5,303,823 A * 4/1994 Niles et al. ..... 206/394
5,330,067 A * 7/1994 Gronnevik ..... 220/7
5,538,153 A * 7/1996 Marovskis et al. ..... 220/6
5,788,103 A * 8/1998 Wagner et al. ..... 220/6
6,398,054 B1 * 6/2002 Overholt et al. ..... 220/7

FOREIGN PATENT DOCUMENTS

| | | |
|---|---|---|
| JP | 63-82941 | 4/1988 |
| JP | 2-148931 | 12/1990 |
| JP | 8-18939 | 12/1996 |
| JP | 10-101066 | 4/1998 |
| JP | 10-101067 | 4/1998 |
| JP | 2958339 | 7/1999 |

* cited by examiner

*Primary Examiner*—Monica Carter
*Assistant Examiner*—Eric A. Gates
(74) *Attorney, Agent, or Firm*—Vern Maine & Associates

(57) ABSTRACT

An open top box-shaped container is provided having a pair of confronting end walls tiltably pivoted and coupled to a bottom wall, wherein the end walls are pivoted at the bottom wall so as to be folded in contact with a top of the bottom wall, a pair of side walls are tiltably pivoted and coupled to the bottom wall so as to be folded in contact with a top of the end walls, wherein a side stopping protrusion is formed on a pivoting side edge of the side walls, that side stopping protrusion being a sectional U shape, such that when the side wall is in an erect position a side stopping groove on the bottom wall mates with each side stopping protrusion to form an erect side stopping structure.

6 Claims, 6 Drawing Sheets

CONTAINER

CROSS REFERENCE TO RELATED APPLICATIONS

This application claims priority under 35 U.S.C. Section 365(c) of the PCT International application PCT/JP00/08416, designating the United States of America, which claims priority from a Japanese Patent Application No. 11-341278 filed on Sep. 30, 1999, which is incorporated herein by reference for all purposes.

BACKGROUND OF THE INVENTION

1. Technical Field of the Invention

The present invention relates to a plastic container having foldable side walls with a pivotal structure disposed at each side of a bottom wall capable of forming a box-shaped container with an open top by erecting each side wall, and also capable of being folded when not in use.

2. Background Art

Plastics play an indispensable role in a wide variety of markets, including packaging, building, construction, transportation, consumer and institutional products, furniture and furnishings, electrical/electronic components, adhesives, inks and coatings. The plastics industry is also one of the largest manufacturing industries in the world.

With respect to packaging, plastics provide advantages that are not otherwise possible with traditional materials. Different plastics offer different qualities, giving manufacturers and consumers the freedom to choose the type of plastic that best suits the application. Plastics can be rigid when protection is needed, or flexible for other applications. The plastic packaging can be clear, opaque, or any color. And it can be molded into a wide variety of shapes and sizes.

In medical facilities, plastic packaging offers a superior ability to protect products against contamination. The chemical resistance properties, transparency and toughness of plastics enhance safety and efficiency in both the laboratory and day-to-day hospital use. Plastics, which can conform to any shape and guard against impurities, are the perfect materials for shipping and storing intricate medical instruments. And in uses such as see-through and break-resistant containers, plastic packaging has proven indispensable in modern medical care.

For home use, the break-resistant, shatterproof and sturdy plastic packaging reduces both injuries and cleaning by providing an easy product to use for storing detergents, cleaning agents and similar goods. Food-service outlets and their customers rely on plastic packaging to protect food products against contamination and retain desired temperatures longer during transport.

The use of plastics and plastic containers for shipping and storage is rapidly growing. Strong, durable and cost effective, plastic assemblies saves energy, space and money. Plastic containers generally require less energy to manufacture than other packaging, require less fuel to transport than heavier counterparts, and occupy less volume for shipping and storage than traditional products. There are further reductions in shipping damage and elimination of the need for additional packing materials, such as partitions between individual products. Strong enough for stacking and moldable into space-saving shapes, plastic containers maximize transport space, and warehouse room.

Plastic containers can also meet unique packaging concerns including anti-static protective properties, thermal stable packaging, and anti-bacterial and anti-microbial properties in the packaging. The container can be molded to fit contours and spacing requirements to provide the ultimate protection in packaging office machines, entertainment units, computer components and other delicate products. These plastic package products are tough enough to withstand the stresses of transportation yet capable of screening out dust and dirt.

Another benefit of plastic containers is that they can be adapted to other uses to reduce waste in landfills and satisfying needs in other markets. And, recycled plastics provide an even further incentive to use plastics for packaging, with the recycled materials are used to create new products. The safe, sanitary, easy to use and economical, plastic packaging is the preferred choice for many.

A particularly useful packaging system is a collapsible container. Rigid containers occupy too much space and are difficult to work with when stacked. The collapsible containers found in the prior art are prepared with side attachment walls free from a bottom wall and attached to a bottom wall with a hinge on each side of a bottom wall. The container can be assembled by attaching side walls to the bottom wall. A side attachment wall is connected to a bottom wall, and the collapsible structure is assembled into a container by unfolding the sidewalls to extend approximately perpendicular to the bottom wall.

The collapsible container indicated in Japanese Patent JP 06-42657 contains side attachment walls that hinge onto the bottom wall. The method of making the container walls results in a burr on the metal mold, and suffers from a low luminous efficacy rate of effective resin, and a metal mold size that is large. U.S. Pat. No. 4,615,464 describes a molded container case comprising a cover and a base with a hinged connector pivotably joining the cover and the base.

The prior art also describes a container for storing or transporting articles, wherein the container has side walls interconnected to the bottom wall and assembled by erecting the side walls. Such an article is shown, for example, in Japanese Patent Application Laid-Open No. 63-82941 or JP-A No. 2958339. In this type of assembly type container, the foldable side walls are provided on each side of the bottom wall by way of thin hinges, and adjacent side walls are mutually engaged to set up the container.

In the assembly type container disclosed in JP-A No. 63-82941 or JP-A No. 2958339, as the container is disassembled, the side walls are spread flat around the bottom wall of the container, but it is bulky and difficult to stow away, store or carry. In addition, the side walls are linked to the bottom wall by the thin hinges, and if a load is applied to the side walls in the downward direction, the load is borne by the thin hinges, and more easily broken.

Another container for storage and transportation is disclosed in JP-A No. 10-101066 and JP-A No. 10-101067. These devices by the present inventor has foldable side walls provided on each side of the bottom wall through hinges of a pivotal structure, and the container is set up by erecting and mutually engaging the adjacent side walls. The container disclosed in JP-A No. 10-101066 and JP-A No. 10-101067, provides for convenient stowing since the side walls can be folded to be parallel to the bottom wall. The folded container is therefore convenient for stowing, storing or carrying. And, since the side walls are linked to the bottom wall by hinges of a pivotal structure, if a load is applied to the side walls in the downward direction, the hinges are rarely broken. This is particularly important when stacking the containers.

Despite the advantages of the prior art container design, these designs lack a mechanism for holding the side walls securely in the upright position. For example, the container side walls tend to collapse in the process of fastening the mutually adjacent upright side walls. This prior art container design is therefore difficult for one person to assemble and requires more time in forming the container. Although the prior art has attempted to manufacture an efficient container assembly, there is considerable room for improving the ergonomic assembly by improving the design.

SUMMARY OF THE INVENTION

The invention is devised in the light of the problems of the prior art described herein. It is therefore an object of the invention to provide a container capable of folding down the side walls that are foldably coupled to each side of the bottom wall. The confronting side walls are folded along the upper portion of the bottom wall, thereby compactly stowing to the size of the bottom wall when not in use. The container is simple and easy to setup by erecting the side walls to the upright position and uses stopping structures on the side walls and end walls to hold the side walls and end walls in position in order to rigidly secure the container sides.

The present invention is a collapsible container that is made with a sharply decreased burr. In addition, the effective resin rate is raised, and the container is made with a comparatively small-scale metal mold. In addition, the molding process used in the present invention is very precise and results in a narrow face width of the wall sides while still maintaining side walls that are free from the bottom wall.

An object of the invention is an open top box-shaped container, comprising a pair of confronting end walls tiltably pivoted and coupled to a bottom wall, wherein the end walls are pivoted at the bottom wall so as to be folded in contact with the top of the bottom wall, a pair of side walls are tiltably pivoted and coupled to the bottom wall so as to be folded in contact with a top of the side walls, wherein a side stopping protrusion is formed on a pivoting side edge of the side walls, the side stopping protrusion being a sectional U shape, wherein a side stopping groove on the base section mates with each side stopping protrusion to form an erect side stopping structure.

An additional object is the container, wherein an end stopping protrusion is formed on a pivoting side edge of the end walls, the end stopping protrusion being a sectional U shape, wherein an end stopping groove on the base section mates with each end stopping protrusion to form an erect end stopping structure.

Yet a further object is the invention, wherein a pivoting position between the bottom wall and the side wall is formed inside of the erect side stopping structure. And, wherein a pivoting position between the bottom wall and the end wall is formed inside of the erect end stopping structure.

Another object of the invention, wherein the container further comprises a second erect side stopping structure comprised of a side stopping receiving groove at a side portion of the side stopping groove, and a side stopping pawl at a side of the side stopping protrusion. In addition, the container further comprising a second erect end stopping structure comprised of an end stopping receiving groove at aside portion of the end stopping groove, and an end stopping pawl at a side of the end stopping protrusion.

A further object of the invention is where the bottom wall, the side walls, and the end walls are of a hollow double wall structure.

The box-shaped container with the open top employs walls tiltably pivoted and coupled to the bottom wall and erecting each wall of the container. There is a pair of opposing end walls coupled to the ends of the bottom wall that are pivoted at the bottom wall so as to be folded onto the top of the bottom wall. And, there is a pair of opposing side walls that are pivoted to the bottom wall side so as to be folded onto the top of the pair of folded end walls. It should be apparent that the containers are also made so that the side walls are folded first and the end walls fold onto the side walls. A means for fastening secures the erect end walls and the side walls to maintain the walls rigidly in position.

The invention employs an erect stopping structure consisting of stopping protrusions and stopping grooves disposed between the pivoting edges of the pair of side walls and/or the pair of end walls with the corresponding bottom wall.

A further object of the invention includes the container assembly wherein the bottom wall and side walls are of hollow double wall structure.

It is an object of the present invention to provide a collapsible container allowing the container to be more conveniently stored when not in use.

It is another object of the present invention to provide a collapsible container with components that are easily, inexpensively, and speedily fabricated.

It is a further object of the present invention to provide a collapsible container constructed from durable materials, such as plastic.

It yet another object of the present invention to produce components of a collapsible container substantially precisely, with few burrs.

It is still another object of the present invention to produce components of a collapsible container via a manufacturing process utilizing a minimal amount of factory space.

Still other objects and advantages of the present invention will become readily apparent to those skilled in this art from the following detailed description, wherein I have shown and described only a preferred embodiment of the invention, simply by way of illustration of the best mode contemplated by me on carrying out my invention. As will be realized, the invention is capable of other and different embodiments, and its several details are capable of modifications in various obvious respects, all without departing from the invention.

BRIEF DESCRIPTION OF THE DRAWINGS

The present invention will be readily understood by the following detailed description in conjunction with the accompanying drawings, wherein like reference numerals designate like structural elements, and in which.

DESCRIPTION OF THE PREFERRED EMBODIMENT

Figure 1:
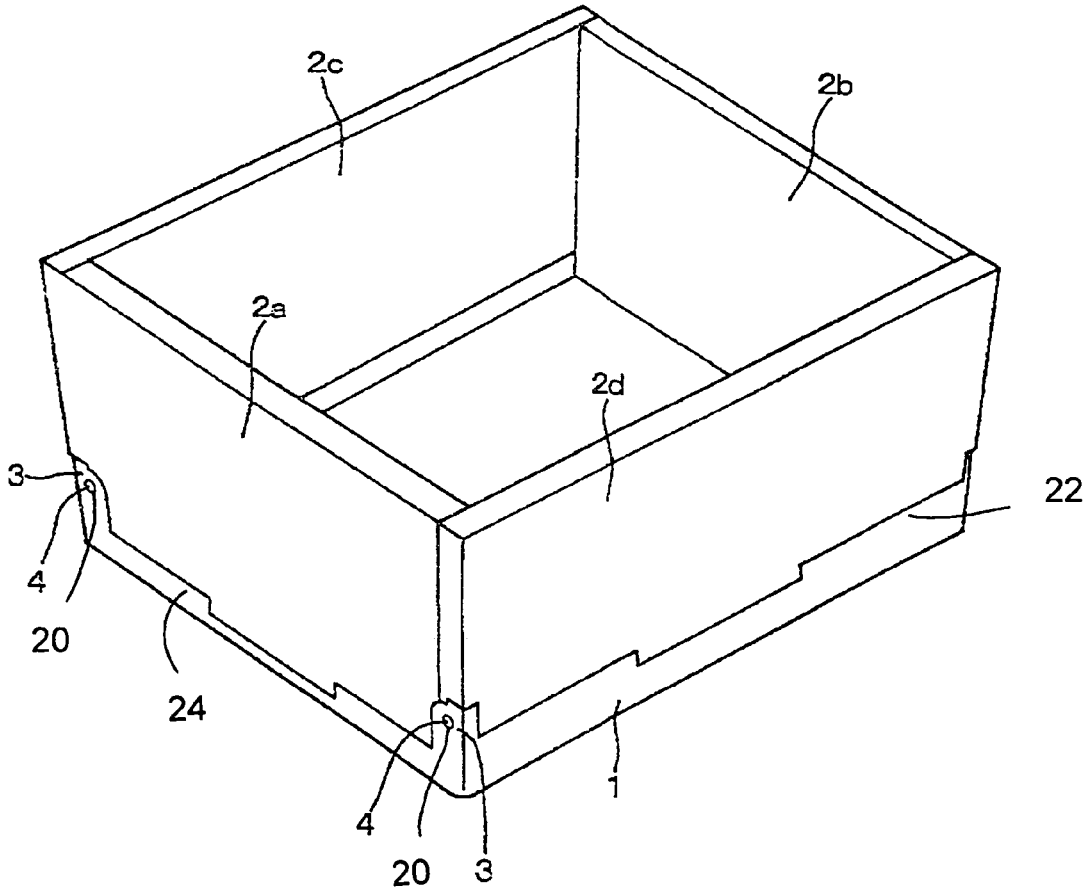
FIG. 1 is an overall perspective view of an assembly type container according to an embodiment of the invention.

The preferred embodiment of the invention is a collapsible container as illustrated in FIG. 1. Referring to FIG. 1, a base section 1, is connected to first 2*a* and second 2*b* end walls and first 2*c* and second 2*d* side walls. The sections and walls, 1, 2*a*, 2*b*, 2*c*, 2*d* are manufactured using hollow double-frame construction and are composed of thermoplastic, such as polyethylene, polypropylene, or other engineered plastic, that has been blow molded. Thus the walls are lightweight and capable of a multitude of complex shapes and sizes. While it is noted that the sections are labeled end walls and side walls, it is readily apparent that the container can be a square having equal length end walls and side walls. The label of end wall is generally applied to the pair of opposing walls that are shorter in length than the pair of side walls. While shown as a rectangle in FIG. 1, there are other shapes that can benefit from the advantages of the present invention.

In the preferred embodiment, the base section 1 has ridges 22, 24 elevated from the plane of the base section 1, wherein the side ridges 22 are higher on the sides of the base section 1 as compared to the ridge 24 at base section ends. Molded protuberances or corner pieces 3 extend from the corners of the container, at each transition between the higher elevation 22 of the sides 2*c*, 2*d*, and the lower elevation 24 of the ends 2*a*, 2*b*. Furthermore, a hole 20 is introduced in the corner sections on the ends.

In this one embodiment, each wall 2*a*, 2*b*, 2*c*, 2*d* is substantially rectangular in shape. On the side walls 2*c*, 2*d* at the corner proximate to the base section 1, the corner is notched and a trunion or bearing pin 4 is molded into the wall frame. This bearing pin 4 mates with the hole 20 and secures the side wall in place when the pins 4 are placed into the holes 20. As the material is plastic, there is some pliability to enable the pins 4 to be positioned into the holes. A similar trunion or bearing pin 5 is on both corners of the end wall sections and inserts into a molded hole (not shown) molded into the base section 1, wherein the molded hole is not visible from the exterior. A further description of the mating connections between the walls and the base section is described in Japanese Patent Applications JP 08-278650 and JP 08-278651.

Figure 2:
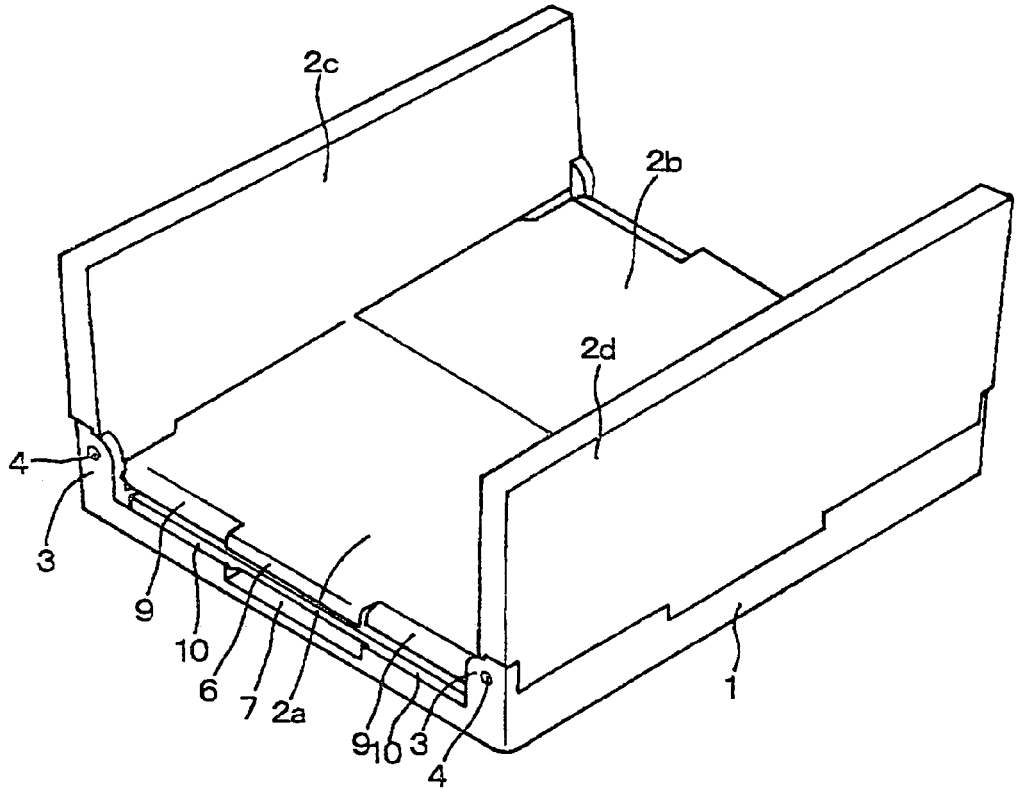
FIG. 2 is an overall perspective view showing a plaited form of a pair of side wall thereof.

In a preferred embodiment, the base section 1 performs a hinging function that is incorporated into the structure of the base section. These hinging is a means of interconnecting the walls 2*a*, 2*b*, 2*c*, 2*d* while allowing each wall to freely move from a position approximately perpendicular to the base wall to one parallel to the base section when folded. The hinging as shown in FIGS. 1 and 2, wherein the molded protuberances 3 extend perpendicular from the corners of the base wall. The protuberances 3 have an outer hole 20, allowing a corresponding bearing pin 4 on the end of the side wall (2*c*, 2*d*) to be introduced. This pin 4 holds the side wall 2*c*, 2*d* securely, while allowing the wall to pivot, with the pin 4 rotating within the hole 20.

FIG. 2 illustrates a preferred embodiment of the invention wherein the end walls 2*a*, 2*b* have been folded to be parallel to the base section 1. The edges of the walls 2*a-d* are molded such that there are one or more protrusions 6 that engages or mates with a corresponding indentation 7 in the edge of the base section 1. These protrusions 6 interface with their corresponding indentation 7 so as to prevent the wall 2*a-d*, from opening to an angle greater than 90°. The edge of the walls 2*a-d* proximate to the base section 1 where there is no protrusion 6, is a beveled molding 9 to allow ease of opening. A complementary molding 10 the corresponding portion of the base section 1 engages the beveled molding 9.

Figure 3:
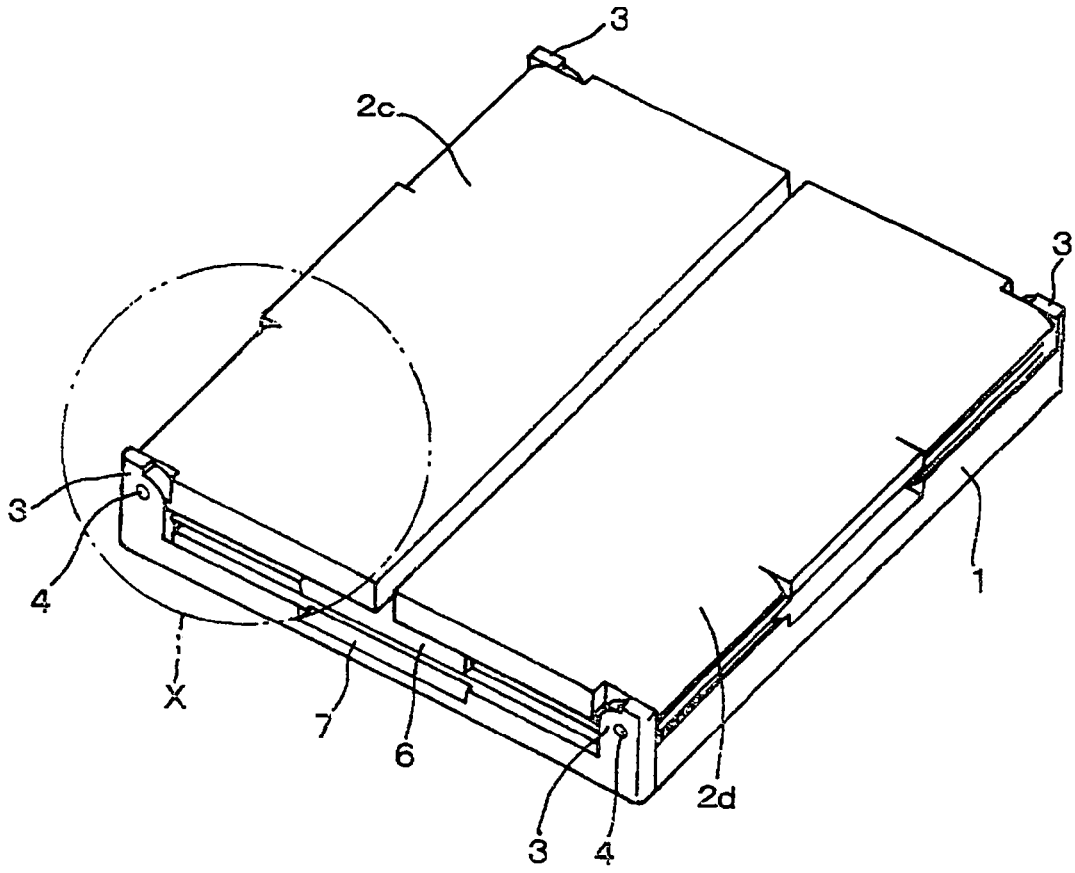
FIG. 3 is an overall perspective view showing a plaited form of both a pair of side wall and other pair of side walls thereof.

FIG. 3 illustrates a preferred embodiment of the invention wherein the walls 2*a-d* are collapsed or folded upon each other and on the base section. This configuration allows for the container to be more easily stored when not in use. This view also more clearly illustrates the arrangement of the hinge formed by the protuberances 3 and the trunions or pins 4. The area delineated by the dotted circle is shown in exploded views in FIG. 4. One skilled in the art will readily see the interrelationship between the elements described above in this view.

Figure 4:
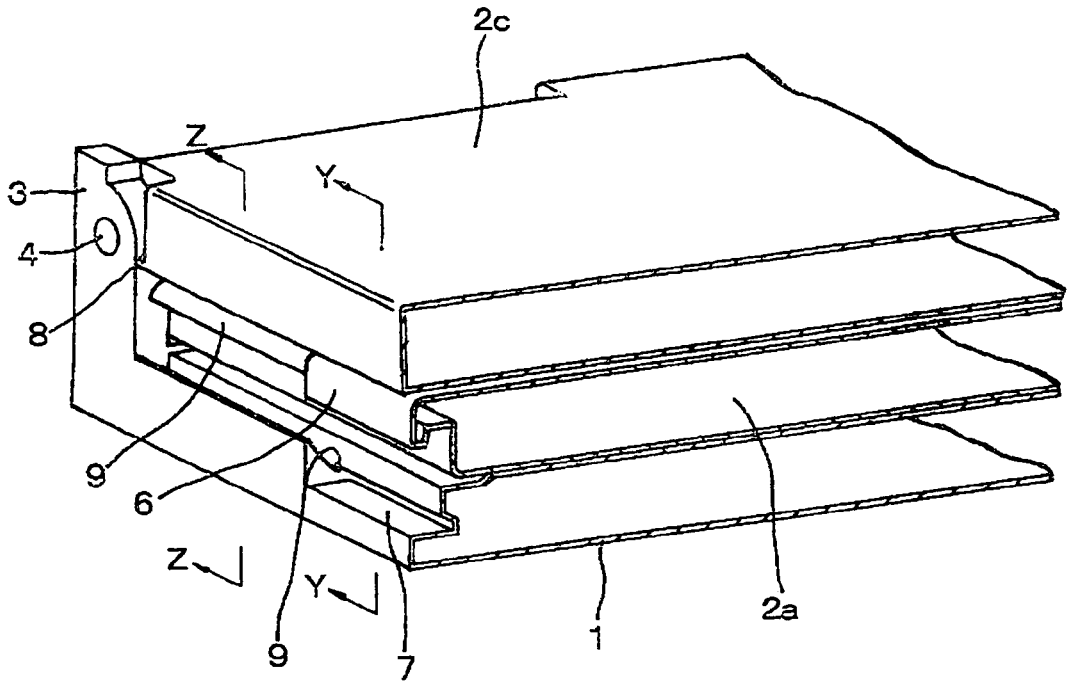
FIG. 4 is a magnified perspective sectional view of a portion enclosed by broken line circle X in FIG. 3.

Referring to FIG. 4, the container is comprised of a bottom wall 1, and four walls 2*a*-2*d* foldably coupled to the bottom section 1 in a pivotal fashion. There are a pair of opposing side walls 2*a*, 2*b*, and a pair of opposing end walls 2*c*, 2*d*.

The bottom section or panel 1 and the four walls 2*a* to 2*d* are formed in hollow double wall structure by blow molding of thermoplastic synthetic resin (for example, high density polyethylene, polypropylene, engineering plastic).

The walls 2*a*-2*d* are coupled to the bottom section 1 of the container, such that the pair of opposing end walls 2*a*, 2*b* are pivoted at the bottom section 1 side so as to be integrally in contact with the top of the bottom section 1. The pair of opposing side walls 2*c*, 2*d* are pivoted to the bottom wall 1 side so as to be integrally in contact with the top of the upper surface of the bottom section 1. Thus, at the four corners of the bottom section 1, individual pivoting portions 3 are erected and formed from the upper surface of the bottom wall 1, and at the four pivoting portions 3, the pair of end walls 2*a*, 2*b* are pivotably in contact with the top of the bottom section 1, and the pair of side walls 2*c*, 2*d* are pivotably in contact with the upper surface of the bottom section 1. Pins 4 of the side walls 2*c*, 2*d*, and pins 5 of the end walls 2*a*, 2*b*, are inserted and affixed in the holes provided in the corner portions 3 of the bottom section 1.

At the pivoting side edges of the pair of side walls 2*a*, 2*b* and other pair of side walls 2*c*, 2*d*, stopping protrusions 6 are formed, and at the corresponding positions of the bottom wall 1, stopping grooves 7 are formed, and an erect stopping structure of the side walls 2*a*, 2*b*, 2*c*, 2*d* is formed by these stopping protrusions 6 and stopping grooves 7, and in particular this erect stopping structure is designed to support the engaged state of the stopping protrusions 6 and stopping grooves 7, so that the side walls 2*a*, 2*b*, 2*c*, 2*d* are held securely in upright position.

Figure 5:
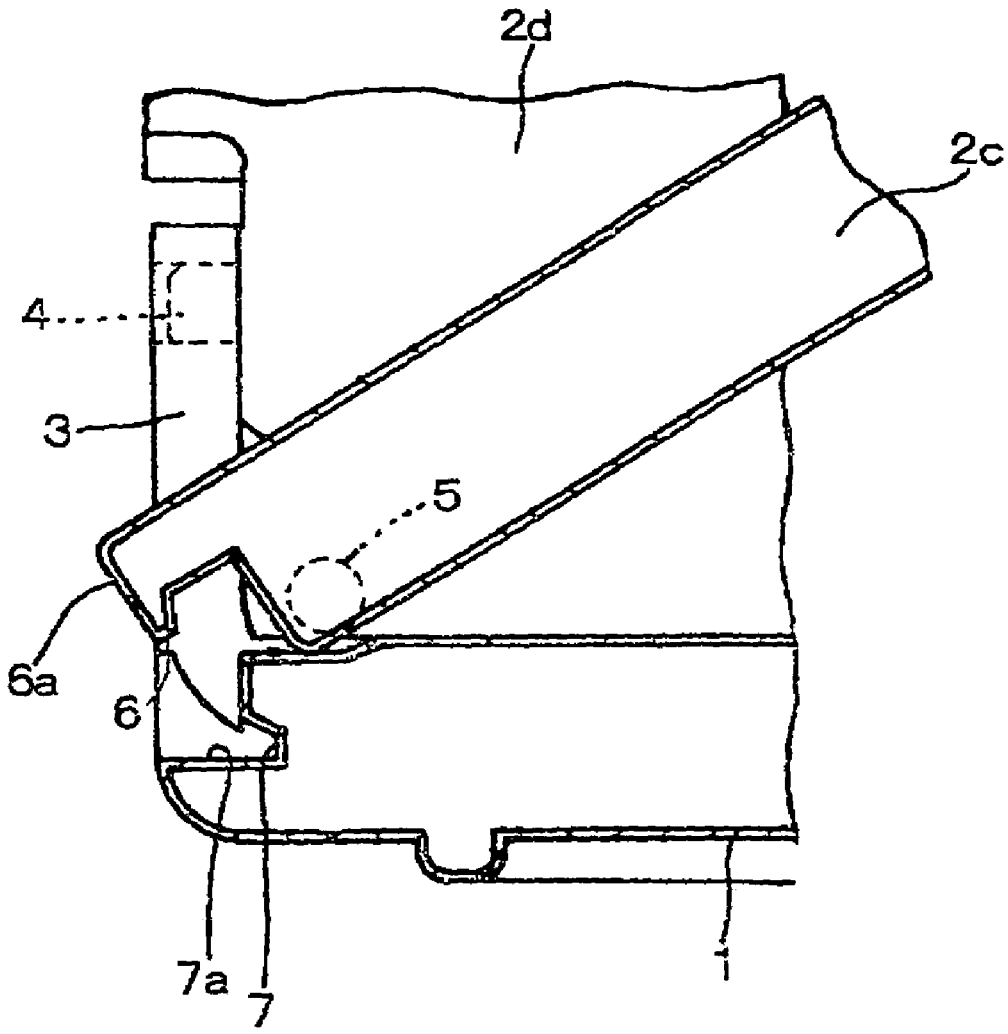
FIG. 5 is a magnified sectional view along line Y-Y in FIG. 4.

In the erect stopping structure by the stopping protrusions 6 and stopping grooves 7, as shown in FIG. 5, the leading end 6*a* of the stopping protrusion 6 is horizontal, and the corresponding stopping groove 7 has a horizontal receiving portion 7*a*.

Accordingly, if a load is applied in the downward direction in the upright position of the side walls 2*a*, 2*b*, 2*c*, 2*d*, the load is borne by the receiving portions 7*a* of the stopping grooves 7, so that no load is applied to the pivotal structure of the pivots 4, 4, 5, 5. A secure engaged state is maintained so that the side walls 2*a*, 2*b*, 2*c*, 2*d* may not collapse outward, and by applying a slight impact to the side walls 2*a*, 2*b*, 2*c*, 2*d* inward from the outside, they can be easily plaited down in a flat state on the bottom wall 1.

Figure 6:
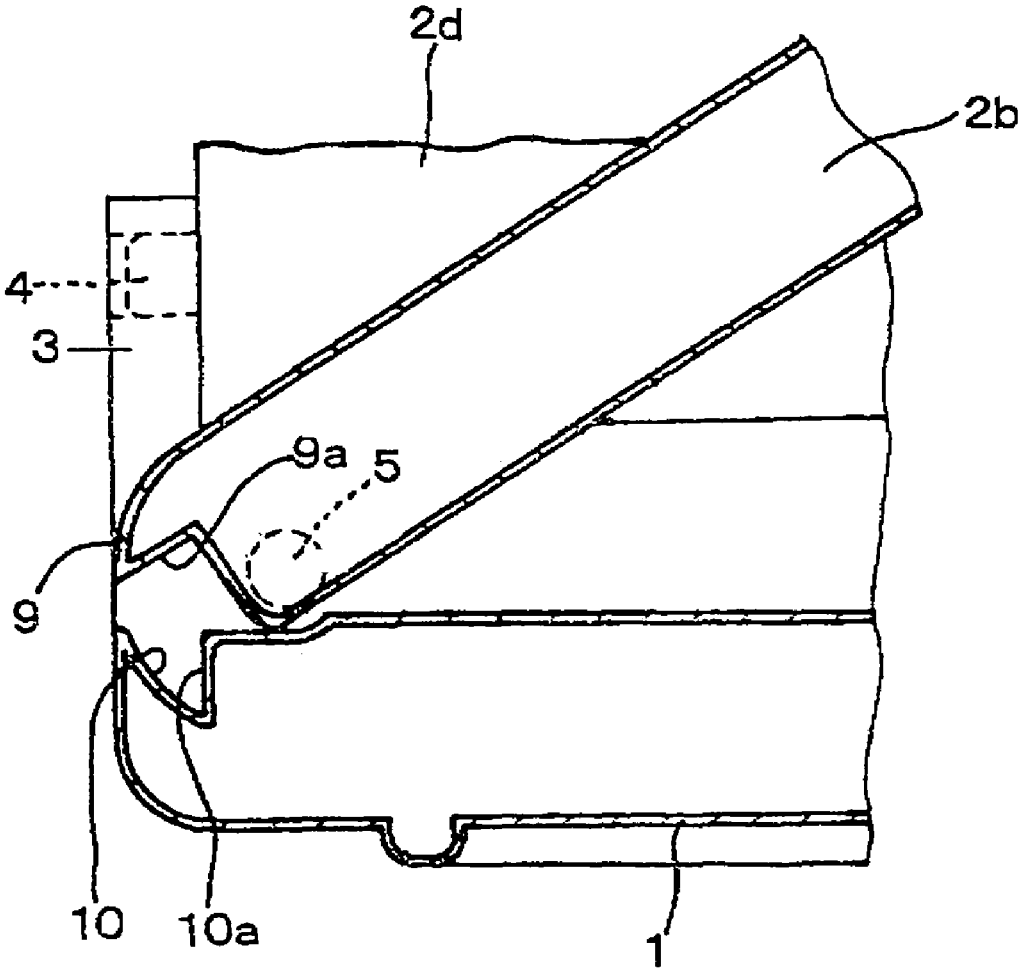
FIG. 6 is a magnified sectional view along line Z-Z in FIG. 4.

Of the side walls 2*a*, 2*b*, 2*c*, 2*d*, the other pair of side walls 2*c*, 2*d* are provided with steps 8 for engaging with the pivoting portions 3 at the both ends, and the pair of side walls 2*a*, 2*b* form an erect stopping structure at both ends. At the pair of side walls 2*a*, 2*b*, pawls 9 are formed at both sides of the stopping protrusions 6, and the receiving groove 10 is formed in an upright state of the side walls 2*c*, 2*d*. The pawls 9 and receiving grooves 10 have flat portions 9*a*, 10*a* engaging with each other in an upright state of the side walls 2*a*, 2*b*, 2*c*, 2*d* as shown in FIG. 6, so that the side walls 2*a*, 2*b*, 2*c*, 2*d* are held upright in an accurate vertical position.

To assemble the container of the invention, from the flat plaited state as shown in FIG. 3, first the other pair of side walls 2*c*, 2*d* are erected, and then the pair of side walls 2*a*, 2*b* are erected, so that a box-shaped container with an open top is formed. That is, when the other pair of side walls 2*c*, 2*d* are erected, the stopping protrusions 6 are engaged with the stopping grooves 7, and the steps 8 at both ends are engaged with the pivoting portions 3 so that an upright position is held securely.

When the pair of side walls 2*a*, 2*b* are erected in succession, the stopping protrusions 6 are engaged with the stopping grooves 7, and the pawls 9 are engaged with the receiving grooves 10, so that an upright position is held securely. Thus, only by erecting the side wall 2*a*, 2*b*, 2*c*, 2*d* in the instructed sequence, the container can be set up.

To plait down the container, first, the pair of side walls 2*a*, 2*b* are tilted in a state of contacting with the top of the bottom wall 1 by applying a slight impact force inward, and then the other pair of side walls 2*c*, 2*d* are similarly tilted, and the pair of side walls 2*a*, 2*b* are plaited down on the bottom wall 1, and the other pair of side walls 2*c*, 2*d* are plaited down thereon, so as to be in a flat compact form as shown in FIG. 3.

The invention is not limited to the illustrated embodiment alone, but is realized in various modified or changed modes. That is, in the illustrated embodiment, the bottom wall 1 and the side walls 2*a*, 2*b*, 2*c*, 2*d* are all in hollow double wall structure, but the object of the invention is similarly achieved if they are formed in a single wall structure.

The objects and advantages of the invention may be further realized and attained by means of the instrumentalities and combinations particularly pointed out in the appended claims. Accordingly, the drawing and description are to be regarded as illustrative in nature, and not as restrictive.

The invention claimed is:

1. An open top box-shaped container, comprising:

a pair of confronting end walls tiltably pivoted and coupled with first and second bearing pins to a bottom wall, wherein said end walls are pivoted at the bottom wall so as to be folded in contact with a top of the bottom wall, wherein an end stopping protrusion is formed on a pivoting side edge of the end walls, a pair of side walls are tiltably pivoted and coupled with third and fourth bearing pins to the bottom wall, wherein a side stopping protrusion is formed on a pivoting side edge of the side walls, said first and second bearing pins being molded at opposing corners of said end walls and said third and fourth bearing pins being molded at opposing corners of said side walls and projecting into corresponding holes disposed in said bottom wall such that end walls are folded in contact with said top of said bottom wall and said side walls are folded in contact with a top of said end walls, and said end stopping protrusion and side stopping protrusion being a sectional U shape having a horizontal leading end, such that when said side walls are in an erect position an end stopping groove and a side stopping groove having a horizontal receiving portion on said bottom wall mates with each said side stopping protrusion to form an erect side stopping structure so that substantially no load is applied to the bearing pins when a load is applied in the downward direction to erect said end walls and said side walls.

2. The container according to claim 1, wherein a pivoting position between the bottom wall and the side wall is formed inside of the erect side stopping structure.

3. The container according to claim 1, wherein a pivoting position between the bottom wall and the end wall is formed inside of the erect side stopping structure.

4. The container according to claim 1, further comprising a second erect side stopping structure comprised of a side stopping receiving groove at a side portion of the side stopping groove, and a side stopping pawl at a side of the side stopping protrusion.

5. The container according to claim 1, further comprising a second erect end stopping structure comprised of an end stopping receiving groove at a side portion of the end stopping groove, and an end stopping pawl at a side of the end stopping protrusion.

6. The container of claim 1, wherein the bottom wall, side walls, and end walls are a hollow double wall structure.

* * * * *